US011639587B2

(12) United States Patent
Ramaekers

(10) Patent No.: US 11,639,587 B2
(45) Date of Patent: May 2, 2023

(54) FRICTION-INCREASING ELEMENT FOR ATTACHMENT TO A ROADBLOCK, AND ROADBLOCK PROVIDED WITH AT LEAST ONE SUCH FRICTION-INCREASING ELEMENT

(71) Applicant: L Metaal Acquisition, Inc., Toronto (CA)

(72) Inventor: Nicky Joseph Gerardus Ramaekers, Eygelshoven (NL)

(73) Assignee: L Metaal Acquisition, Inc.

( * ) Notice: Subject to any disclaimer, the term of this patent is extended or adjusted under 35 U.S.C. 154(b) by 275 days.

(21) Appl. No.: 16/842,873

(22) Filed: Apr. 8, 2020

(65) Prior Publication Data

US 2020/0325643 A1 Oct. 15, 2020

(30) Foreign Application Priority Data

Apr. 11, 2019 (NL) ..... 2022924

(51) Int. Cl.
*E01F 15/14* (2006.01)
*E01F 13/12* (2006.01)
*E01F 15/08* (2006.01)

(52) U.S. Cl.
CPC ..... *E01F 15/14* (2013.01); *E01F 13/12* (2013.01); *E01F 15/08* (2013.01)

(58) Field of Classification Search
CPC . E01F 15/08; E01F 15/10; E01F 15/14; E01F 13/12
See application file for complete search history.

(56) References Cited

U.S. PATENT DOCUMENTS 2,009,947 A 7/1935 Powning
4,059,362 A * 11/1977 Smith ..... E01F 15/083 404/6
4,569,422 A 2/1986 Hoffman
5,054,954 A * 10/1991 Cobb ..... E01F 15/085 404/6
6,139,250 A 10/2000 Nolasco
7,111,544 B2 9/2006 Kohlstedt et al.
7,351,002 B2 * 4/2008 Yodock, III ..... E01F 15/083 404/6
7,600,942 B2 * 10/2009 Yodock, III ..... E01F 15/088 404/6
10,508,393 B1 * 12/2019 Page ..... E01F 13/02
(Continued)

FOREIGN PATENT DOCUMENTS

DE 29606934 U1 8/1996
DE 19953566 A1 5/2000
(Continued)

*Primary Examiner* — Abigail A Risic
(74) *Attorney, Agent, or Firm* — Scheef & Stone, LLP; John G. Fischer; Jack D. Stone

(57) ABSTRACT

The present invention relates to a friction-increasing element for attachment to a roadblock, comprising: a friction-increasing element body for attachment to the roadblock, and at least one tapered contact edge, which tapered contact edge is carried by the friction-increasing element body such that the tapered contact edge is facing away from the friction-increasing element body. The invention also relates to a roadblock provided with a least one of such friction-increasing element.

15 Claims, 3 Drawing Sheets

(56) References Cited

U.S. PATENT DOCUMENTS

| | | | | |
|---|---|---|---|---|
| 2009/0278102 | A1* | 11/2009 | Yu | E01F 15/086 256/13.1 |
| 2010/0014914 | A1* | 1/2010 | Kulp | E01F 15/088 404/6 |
| 2010/0061800 | A1* | 3/2010 | Riddell | E01F 15/10 404/6 |
| 2010/0290833 | A1* | 11/2010 | Whitford | F41H 5/14 404/6 |
| 2017/0204575 | A1* | 7/2017 | Klein | E06B 11/027 |
| 2020/0173121 | A1* | 6/2020 | Klein | E01F 13/12 |
| 2020/0378078 | A1* | 12/2020 | Weissberg | F41H 11/08 |

FOREIGN PATENT DOCUMENTS

| | | | | |
|---|---|---|---|---|
| DE | 102013111269 | A1 | 7/2015 | |
| DE | 202017103479 | U1 * | 7/2017 | F41H 11/08 |
| DE | 102019102019 | A1 * | 7/2020 | F41H 11/08 |
| EP | 0485746 | A1 * | 5/1992 | E01F 15/085 |
| EP | 1650353 | A2 | 4/2006 | |
| EP | 3323942 | A1 * | 5/2018 | E01F 13/022 |
| EP | 3575493 | A1 * | 12/2019 | E01F 13/12 |
| EP | 3800293 | A1 * | 4/2021 | E01F 9/688 |
| FR | 3070169 | B1 * | 10/2020 | E01F 13/12 |
| KR | 100676457 | B1 * | 2/2007 | |
| WO | 03025494 | A1 | 3/2003 | |
| WO | WO-2013030418 | A1 * | 3/2013 | E01F 8/00 |
| WO | WO-2019016812 | A1 * | 1/2019 | E01F 13/12 |
| WO | WO-2021150102 | A1 * | 7/2021 | E01F 15/085 |

* cited by examiner

FRICTION-INCREASING ELEMENT FOR ATTACHMENT TO A ROADBLOCK, AND ROADBLOCK PROVIDED WITH AT LEAST ONE SUCH FRICTION-INCREASING ELEMENT

CROSS-REFERENCE TO RELATED APPLICATION

This application claims priority to The Netherlands Patent Application No. 2022924 filed Apr. 11, 2019, the disclosure of which is hereby incorporated by reference in its entirety.

BACKGROUND OF THE INVENTION

Field of the Invention

The present invention relates to a friction-increasing element for attachment to a roadblock and to a roadblock provided with a least one such friction-increasing element.

Description of Related Art

Roadblocks are temporary installations set up to control or block traffic, e.g. during roadworks, temporary road closure and as a security precaution, as Hostile Vehicle Mitigation (HVM). The usage demands of such roadblocks are various. Preferably a roadblock is easy to install and remove, as well as easy to transport and store. These demands may for instance be provided by an elongated element substantially shaped as a traffic barrier, which traffic barrier may—or may not—be firmly connected to the ground or surface. A further elementary requirement of a roadblock is that it provides an essential blocking functionality as it has to be able to handle the forces exerted on the roadblock exerted by a vehicle that collides with the roadblock. The blocking functionality may be provided by the combination of various technical features like the shape of the roadblock, the weight (mass) of the roadblock, the connection(s) of the roadblock with the surface and/or one or more roadblock support(s). And even when one or more of the possible mounting assemblies break, disconnect from the roadblock and/or when the mounting assemblies detach from their position due to a considerable force being exerted on the roadblock as a result of the impact of a vehicle onto the roadblock, the roadblock still is required to fulfil a blocking function.

An actual development is that there is an enhanced attention for the blocking functionality of roadblocks as a result of an increased awareness in the protection of public spaces. This increased awareness is, among others, a result of several recent terrorist attacks, wherein vehicles (cars and trucks) were used. The request is thus to further enhance the blocking capabilities of—both existing and new—roadblocks. The problem is thus to provide a simple solution to enhance the blocking capabilities of roadblocks.

SUMMARY OF THE INVENTION

This problem is solved with a friction-increasing element for attachment to a roadblock, comprising a friction-increasing element body for attachment to the roadblock, and at least one tapered contact edge, which tapered contact edge is carried by the friction-increasing element body such that the tapered contact edge is facing away from the friction-increasing element body. A "tapered contact edge" within the context of the present invention is referring to an edge (or ridge) that may end in one or more teeth or in any other kind of edge with one or more protruding parts. The one or more peaks or tops of such a toothed edge may or may not be sharp. The advantage of the friction-increasing element according to the present invention is that when a roadblock to which the friction-increasing element may be attached tilts, or is toppled, due to a substantial impact to the roadblock the tapered contact edge of the friction-increasing element may contact the ground (or surface) the roadblock stood on until the moment of impact. Due to the contact of the tapered contact edge the friction between the frictional resistance between the road barrier and the ground increases due to which the further displacement (shift) of the barrier over the ground is inhibited or prevented. The cause of this is the local high pressure on the location(s) where the protruding tooth (teeth) engage on the ground/floor. The tooth or teeth so to say may "bite" into the ground. A further advantageous characteristic of the friction-increasing element according the present invention is that new roadblocks may be provided with one or more of them but also roadblocks that are already in use may easy be adapted by attaching one or more friction-increasing elements. The friction-increasing element according the invention may also be easy, and thus cheap, to produce, requires no specific maintenance and is reliable in use.

In an embodiment the friction-increasing element body and the at least one tapered contact edge may lie in a single plane. Such a friction-increasing element is simple to produce from a flat piece of starting material. Furthermore the friction-increasing element body and the at least one tapered contact edge may be made from a single plate part and as starting material steel may be chosen. In practice steel sheet material is easy to obtain at reasonable prices. Also during the production of prior art traffic barriers and roadblocks often use is made of steel plate material so the production of a steel plate produced friction-increasing element will normally fit the production facilities of traffic barrier and roadblock producers without the demand for substantive changes of adaptation.

In another embodiment the friction-increasing element body may carry at least two tapered contact edges, the at least two tapered contact edges being located on opposite sides of the friction-increasing element body. Such a friction increasing-element may provide an enhanced frictional resistance between a road barrier and the ground in two directions after tilting or toppling of the friction increasing-element. Normally a road barrier has a longitudinal shape and there are in practise only two directions for tilting (forward and back). With two tapered contact edges friction increasing-element may provide its advantages independent of the direction of tilting.

The tapered contact edge may be teethed, wherein an edge with a single tooth is an option, but the edge may also have two or more teeth. Dependent on the user characteristics (e.g. the type of ground/surface the roadblock is normally used) a different shape of tapered contact edge may be preferred. In this respect there may also be chosen for a tapered contact edge made out of a plate material of which the plate thickness narrows towards the tapered contact edge.

There are several options to combine the friction-increasing element with a roadblock. An option is to provide the friction-increasing element body with at least one couple member for connecting the friction-increasing element to a roadblock. A form-fitting coupling between the friction-increasing element and the roadblock may lead to a solid and sturdy connection between the barrier and the friction-increasing element but also standardised loose connections means may be used for coupling. A further feature for simple coupling may be to provide the friction-increasing element body with at least one couple opening for connecting the friction-increasing element to a roadblock.

The friction-increasing element body may also be provided with at least one, but preferably at least two, lifting openings. As the friction-increasing element has to be solidly attached to the roadblock this solid coupling may also be used for the controlled displacement of the roadblock. So the lifting openings enable to attach a manipulator (e.g. a crane) to the friction-increasing element, with which manipulator the roadblock may be installed and/or removed.

The present invention also provides a roadblock provided with a least one friction-increasing element as disclosed above, the roadblock comprising an elongated casing, having two opposing longitudinal side walls and an, the two side walls joining, upper wall; and at least one casing support structure located in the elongate casing and connecting to both the side walls; wherein the friction-increasing element body of a friction-increasing element is attached to the upper wall of the roadblock such that at least one tapered contact edge of the friction-increasing element is protruding from a longitudinal side wall of the roadblock. If such roadblock tilts or topples the contact edge of the friction-increasing element protruding from the longitudinal wall may come in contact with the ground to provide its function. In case two opposite tapered contact edges of the at least one friction-increasing element are protruding from the two opposing longitudinal side walls of the roadblock the additional functionality of enhance frictional resistance to displacement (shift) of the barrier over the ground may be provided independent on the direction of tilting/toppling of the roadblock (thus both: tilting forward or back).

For a solid assembly of a friction-increasing element and a roadblock the friction-increasing element may be attached to the upper wall of the roadblock at a location that is supported by the casing support structure. The forces imposed onto the friction-increasing element may—at the brief moments of its use—be very substantial and thus a solid coupling of the friction-increasing element, in which the forces exerted onto the friction-increasing element may be passed through to the casing support structure, is elementary.

To further enhance the effect sought for the roadblock according the present invention it may also be provided with at least two friction-increasing elements, which friction-increasing elements are preferably spaced apart attached to the upper wall of the roadblock. Not only will plural friction-increasing elements enhance the effect of increasing the frictional resistance between the road barrier and the ground but also the distribution of the forces exerted on the roadblock will be more evenly distributed than when only a single friction-enhancing element is part of the roadblock.

The at least one friction-increasing element may be an integral part of the roadblock and as such included during the production of the roadblock. As an alternative the friction-increasing element may also be attached to a "standard roadblock" later in the production process or even later in the lifecycle of a roadblock. For instance the at least one friction-increasing element may be permanently coupled to the upper wall of the roadblock, e.g. by welding the friction-increasing element body onto the upper wall of the roadblock. An advantage of such attachment method is that roadblocks already in use may simply be converted. A further alternative is that at least one friction-increasing element is releasably coupled to the upper wall of the roadblock, e.g. by bolting the friction-increasing element body onto the upper wall of the roadblock. The advantage of releasable coupling the friction-increasing element body and the roadblock is that a friction-increasing element may also easily be removed and/or exchanged for another friction-increasing element.

BRIEF DESCRIPTION OF THE DRAWINGS

The present invention will be further elucidated on the basis of the non-limitative exemplary embodiments shown in the following figures, herein shows.

DESCRIPTION OF THE INVENTION

Figure 1:
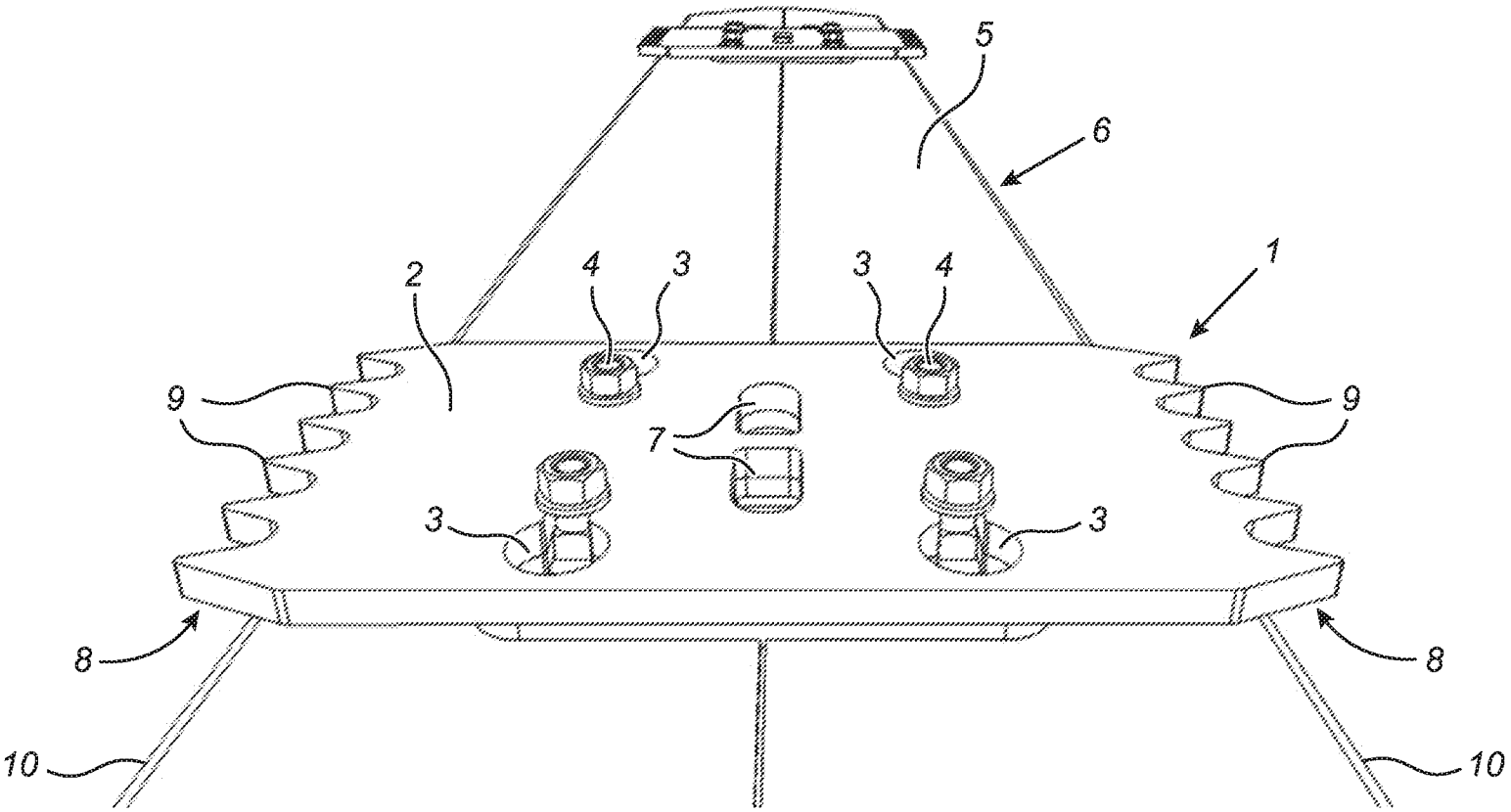
FIG. 1 a perspective view of a friction-increasing element according the present invention that is attached to a roadblock.

FIG. 1 shows a friction-increasing element 1 with a central friction-increasing element body 2 wherein four openings 3 are provided for the passage of fixing bolts 4 to attach the friction-increasing element 1 to an upper wall 5 of a roadblock 6. Also visible are two lifting openings 7 for attachment of a lifting hook (not shown here). On two opposite sides of the friction-increasing element body 2 there are two contact edges 8 (tapered contact edges) with protruding teeth 9. The friction-increasing element 1 is so dimensioned that the teeth 9 of two contact edges 8 protrude from side walls 10 of the roadblock 6.

Figure 2:
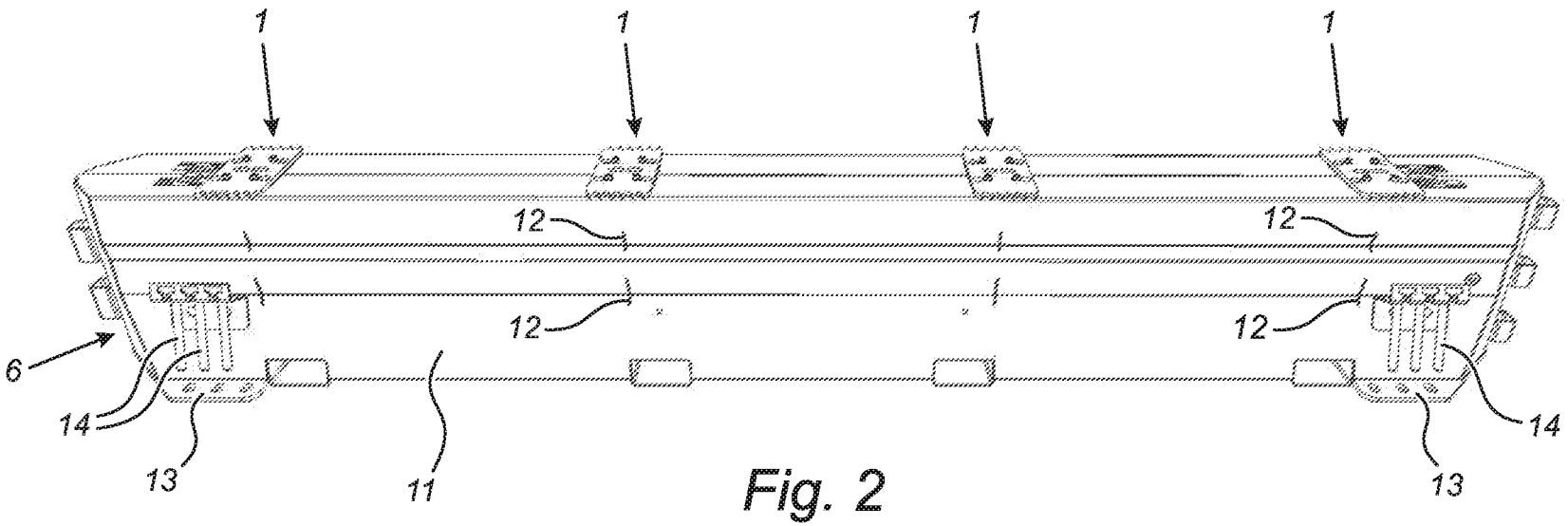
FIG. 2 a perspective view of a roadblock according the present invention with four friction-increasing elements attached.

FIG. 2 shows a perspective side view on the roadblock 6 carrying four spaced apart friction-increasing elements 1. The friction-increasing elements 1 are attached to the roadblock 6 above the location where casing support structures are located in the elongate casing 11, from these casing support structures only parts 12 that protrude from a side wall of the elongate casing 11 are visible in this figure. Also shown are the bottom plates 13 and the anchors 14 for anchoring the roadblock 6 to the ground.

Figure 3:
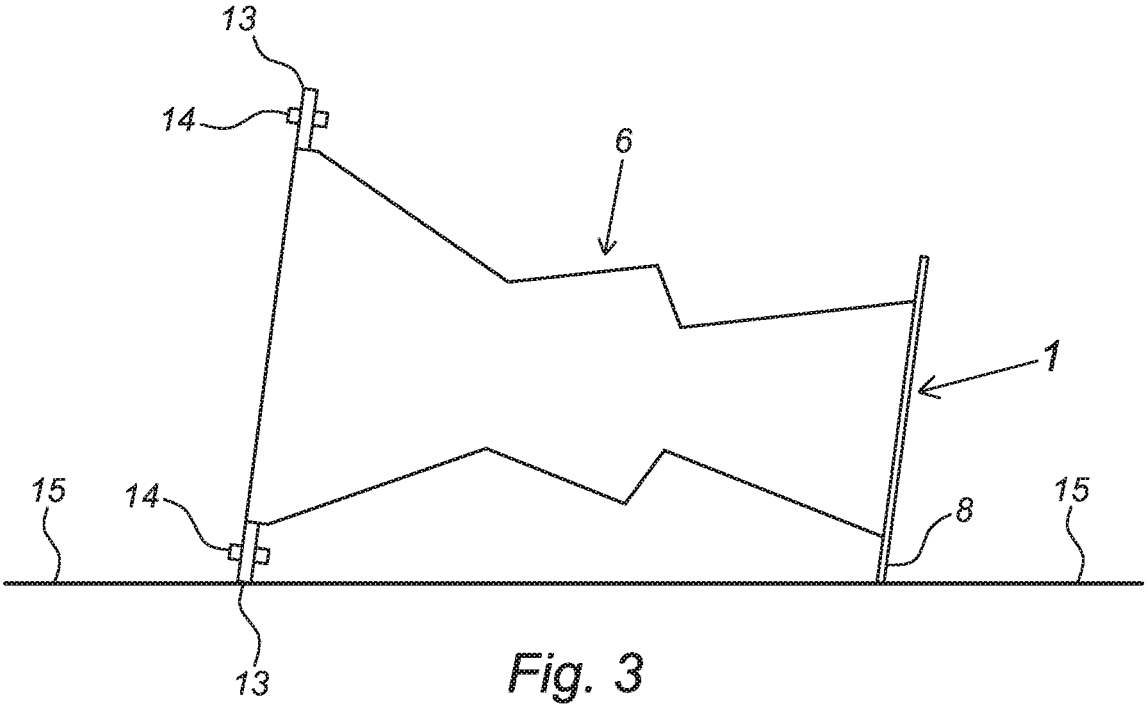
FIG. 3 a schematic side view of a roadblock with friction-increasing element in a toppled/tilted position wherein the roadblock is tilted and the friction-increasing element makes contact with the ground.

FIG. 3 shows a schematic view of a roadblock 6 that is toppled over, e.g. due to a substantial impact. The bottom plates 13 are in the depicted position loose from the ground 15 and the anchors 14 are broken and/or pulled out of the ground 15. The toppling of the roadblock 6 results in the tapered contact edge 8 of the friction-increasing element 1 that protrudes from the sides of the roadblock 6 to contact the ground 15 and makes the toppled roadblock 15 harder to move (shift) over the ground 15 due to the teeth of the contact edge 8 of the friction-increasing element 1 engaging onto the ground 15.

Figure 4A:
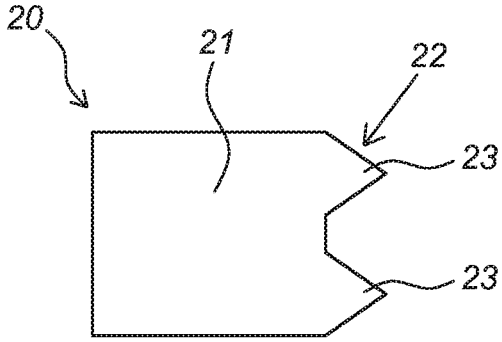
FIGS. 4A-4C schematic top views of three alternative embodiments of friction-increasing elements according the present invention.
Figure 4C:
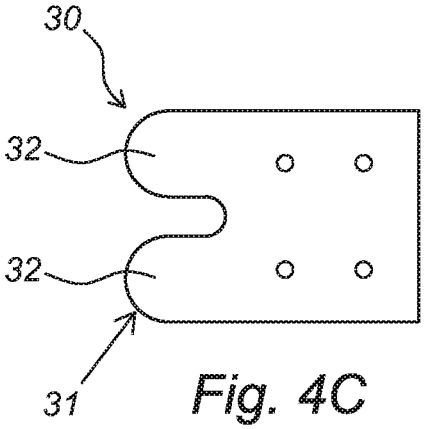
Figure 4B:
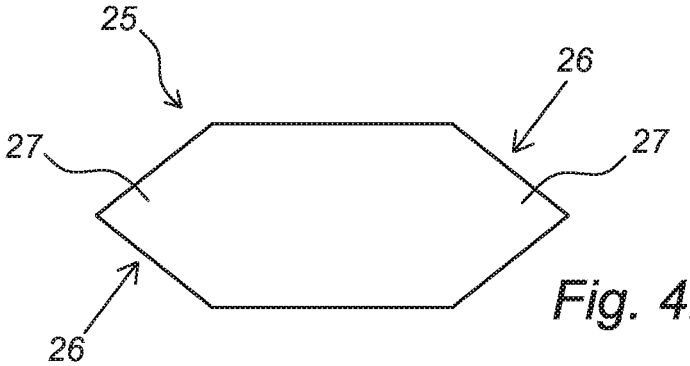

FIG. 4A shows in schematic top view a friction-increasing element 20 according the present invention with a friction-increasing element body 21 for attachment to a roadblock and a single tapered contact edge 22 provided with two protruding teeth 23. In FIG. 4B a further alternative embodiment of a friction-increasing element 25 according the present invention is shown with a friction-increasing element body 21 for attachment to a roadblock and two opposed tapered contact edges 26, both provided with a single protruding tooth 27. FIG. 4C shows a third alternative embodiment of a friction-increasing element 30 according the present invention, now with a single tapered contact edge 31 provided with two rounded protruding teeth 32.

The invention claimed is:

1. A friction-increasing element in combination with a roadblock, the friction-increasing element comprising:

an element body;

a tapered contact edge on the element body;

the element body connectable to an upper wall of a roadblock, the upper wall extending between a pair of opposing side walls of the roadblock; and the tapered contact edge extending beyond a sidewall of the roadblock.

2. The friction-increasing element according to claim 1, further comprising:

the element body and the tapered contact edge being located in a single plane.

3. The friction-increasing element according to claim 1, further comprising:

the friction-increasing element body and the tapered contact edge are made from a single plate part.

4. The friction-increasing element according to claim 1, further comprising:

the element being made of steel.

5. The friction-increasing element according to claim 1, further comprising:

the element body having a tapered contact edges located on each of two opposite sides of the element body and extending beyond each of the opposing sidewalls of the roadblock.

6. The friction-increasing element according to claim 1, further comprising:

the tapered contact edge is teethed.

7. The friction-increasing element according to claim 1, further comprising:

the tapered contact edge having a thickness that narrows towards the tapered contact edge.

8. The friction-increasing element according to claim 1, further comprising:

the element body being provided with at least one couple member for connecting the friction-increasing element to a roadblock.

9. The friction-increasing element according to claim 1, further comprising:

the element body is provided with at least one couple opening for connecting the friction-increasing element to a roadblock.

10. The friction-increasing element according to claim 1, further comprising:

the element body is provided with at least one lifting opening.

11. A roadblock, comprising:

two opposing longitudinal side walls;

an upper wall joining the two side walls;

a friction-increasing element comprising an element body having a tapered contact edge; and the friction-increasing element i s attached to the upper wall of the roadblock such that the tapered contact edge extends beyond the side wall of the roadblock.

12. The roadblock according to claim 11, further comprising:

the element body having a tapered contact edge located on each of two opposite sides of the element body and extending beyond the opposing sidewalls of the roadblock.

13. The roadblock according to claim 11, further comprising:

the roadblock having a plurality of friction-increasing elements attached to the upper wall of the roadblock.

14. The roadblock according to claim 11, further comprising:

the friction-increasing element is releasably coupled to the upper wall of the roadblock.

15. The roadblock according to claim 11, further comprising:

the element body is permanently coupled to the upper wall of the roadblock.

* * * * *